US010738773B2

(12) United States Patent
Tanaka et al.

(10) Patent No.: US 10,738,773 B2
(45) Date of Patent: Aug. 11, 2020

(54) BLOWER

(71) Applicant: Murata Manufacturing Co., Ltd., Kyoto (JP)

(72) Inventors: Nobuhira Tanaka, Kyoto (JP); Kiyoshi Kurihara, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 275 days.

(21) Appl. No.: 15/352,724

(22) Filed: Nov. 16, 2016

(65) Prior Publication Data

US 2017/0058884 A1 Mar. 2, 2017

Related U.S. Application Data

(63) Continuation of application No. PCT/JP2015/060439, filed on Apr. 2, 2015.

(30) Foreign Application Priority Data

May 20, 2014 (JP) ..... 2014-104226

(51) Int. Cl.
*F04B 39/12* (2006.01)
*F04B 45/04* (2006.01)
(Continued)

(52) U.S. Cl.
CPC ..... *F04B 39/123* (2013.01); *F04B 39/121* (2013.01); *F04B 43/0054* (2013.01);
(Continued)

(58) Field of Classification Search
CPC .... F04B 17/003; F04B 39/121; F04B 39/123; F04B 43/023; F04B 43/04; F04B 43/043;
(Continued)

(56) References Cited

U.S. PATENT DOCUMENTS

2009/0087323 A1 4/2009 Blakey et al.
2009/0148318 A1 6/2009 Kamitani
(Continued)

FOREIGN PATENT DOCUMENTS

CN 101490419 A 7/2009
CN 102597520 A 7/2012
(Continued)

OTHER PUBLICATIONS

English Translation JP401167475A Pump Employing Piezoelectric Element.*
(Continued)

*Primary Examiner* — Bryan M Lettman
*Assistant Examiner* — Charles W Nichols
(74) *Attorney, Agent, or Firm* — Pearne & Gordon LLP

(57) ABSTRACT

A piezoelectric blower includes a first valve, a first housing, a vibrating plate, a piezoelectric element, a second housing, and a second valve. The first housing forms, together with the vibrating plate, a first blower chamber. A first top plate portion includes a first vent hole that allows an inside of the first blower chamber to communicate with an outside of the first blower chamber. The second housing forms, together with an actuator, a second blower chamber. A second top plate portion includes a second vent hole that allows an inside of the second blower chamber to communicate with an outside of the second blower chamber. The vibrating plate includes an opening portion and a third vent hole, the opening portion allowing an outer periphery of the first blower chamber and an outer periphery of the second blower chamber to communicate with each other.

23 Claims, 11 Drawing Sheets

(51) Int. Cl.

| | |
|---|---|
| ***F04B 43/00*** | (2006.01) |
| ***F04B 43/04*** | (2006.01) |
| ***F04B 53/16*** | (2006.01) |
| ***F04B 43/02*** | (2006.01) |
| ***F04B 45/047*** | (2006.01) |
| ***F04B 53/10*** | (2006.01) |

(52) U.S. Cl.
CPC ..... *F04B 43/023* (2013.01); *F04B 43/046* (2013.01); *F04B 45/04* (2013.01); *F04B 45/041* (2013.01); *F04B 45/047* (2013.01); *F04B 53/10* (2013.01); *F04B 53/16* (2013.01)

(58) Field of Classification Search
CPC ..... F04B 43/046; F04B 45/04; F04B 45/041; F04B 45/043; F04B 45/047; F04B 53/10; F04B 53/16
See application file for complete search history.

(56) References Cited

U.S. PATENT DOCUMENTS

2011/0081267 A1* 4/2011 McCrone ..... F04B 43/046 417/481
2011/0190670 A1* 8/2011 Jaeb ..... F04B 43/04 601/6
2012/0171062 A1 7/2012 Kodama
2013/0058818 A1* 3/2013 Hirata ..... F04B 43/046 417/479
2015/0023821 A1* 1/2015 Campbell ..... F04B 19/006 417/413.2
2015/0150470 A1 6/2015 Sano

FOREIGN PATENT DOCUMENTS

| | | | |
|---|---|---|---|
| CN | 104302913 | A | 1/2015 |
| JP | S60-195987 | A | 12/1985 |
| JP | H01167475 | A | 7/1989 |
| JP | 4795428 | B2 | 10/2011 |
| WO | 2013117945 | A1 | 8/2013 |
| WO | 2013/179789 | A1 | 12/2013 |
| WO | 2014024608 | A1 | 2/2014 |

OTHER PUBLICATIONS

International Search report issued in PCT/JP2015/060439 dated Jun. 30, 2015.
Written Opinion issued in PCT/JP2015/060439 dated Jun. 30, 2015.

* cited by examiner

BLOWER

This is a continuation of International Application No. PCT/JP2015/060439 filed on Apr. 2, 2015 which claims priority from Japanese Patent Application No. 2014-104226 filed on May 20, 2014. The contents of these applications are incorporated herein by reference in their entireties.

FIELD OF THE DISCLOSURE

The present disclosure relates to a blower that transports gas.

DESCRIPTION OF THE RELATED ART

Hitherto, various types of blowers that transport gas have been known. For example, Patent Document 1 discloses a piezoelectric driven type pump.

The pump includes a piezoelectric disc, a disc to which the piezoelectric disc is joined, and a body that, together with the disc, forms a cavity. The body has an inlet into which a fluid flows and an outlet from which the fluid flows out. The inlet is provided between a central axis of the cavity and an outer periphery of the cavity. The outlet is provided at the central axis of the cavity.

In the pump described in Patent Document 1 and having this structure, a drive voltage is applied to the piezoelectric disc to expand and contract the piezoelectric disc. When the disc undergoes bending vibration by the expansion and contraction of the piezoelectric disc, a fluid is sucked into the cavity from the inlet, and is discharged from the outlet.

Patent Document 1: Japanese Patent No. 4795428

BRIEF SUMMARY OF THE DISCLOSURE

However, blowers of recent years tend to have low power consumption and high discharge flow rate. Therefore, there is a demand for blowers whose discharge flow rate is made considerably higher than that of the pump in Patent Document 1 without increasing power consumption.

Accordingly, it is an object of the present disclosure to provide a blower whose discharge flow rate per power consumption can be considerably increased.

In order to solve the aforementioned problem, a blower according to the present disclosure has the following structure.

The blower according to the present disclosure includes an actuator and a housing.

The actuator includes a vibrating portion and a driving member. The vibrating portion includes a first principal surface and a second principal surface. The driving member is provided on at least one of the first principal surface and the second principal surface of the vibrating portion, and causes the vibrating portion to undergo bending vibration.

The housing includes a first top plate portion, a second top plate portion, and a side wall portion. The first top plate portion forms, together with the actuator, a first blower chamber and includes a first vent hole. The second top plate portion forms, together with the actuator, a second blower chamber and includes a second vent hole. The side wall portion connects the first top plate portion to the vibrating portion and connects the second top plate portion to the vibrating portion.

The vibrating portion includes an opening portion that allows an outer periphery of the first blower chamber and an outer periphery of the second blower chamber to communicate with each other. The side wall portion includes a third vent hole that allows the outer periphery of the first blower chamber and the outer periphery of the second blower chamber to communicate with an outside of the housing.

In this structure, when the driving member is driven, the vibrating portion undergoes bending vibration, and the volume of the first blower chamber and the volume of the second blower chamber change periodically. More specifically, when the volume of the second blower chamber is reduced, the volume of the first blower chamber is increased; and when the volume of the first blower chamber is reduced, the volume of the second blower chamber is increased. That is, the volume of the first blower chamber and the volume of the second blower chamber change in an opposite manner.

Therefore, when the actuator is driven, gas at the outer periphery of the first blower chamber and gas at the outer periphery of the second blower chamber move through the opening portion. Consequently, when the actuator is driven, the pressure at the outer periphery of the first blower chamber and the pressure at the outer periphery of the second blower chamber cancel out through the opening portion, and are atmospheric pressure (node) at all times.

Therefore, even if the outer periphery of the first blower chamber and the outer periphery of the second blower chamber communicate with the outside of the housing via the large opening portion and the third vent hole, the blower having this structure can prevent a reduction in discharge pressure and discharge flow rate.

In addition, when the actuator is driven, the blower having this structure allows gas in the first blower chamber sucked from the third vent hole to be discharged to the outside of the housing via the first vent hole, and gas in the second blower chamber sucked from the third vent hole to be discharged to the outside of the housing via the second vent hole.

Therefore, the blower having this structure can make the discharge flow rate per power consumption considerably higher than the discharge flow rate of the pump that is described in Patent Document 1 and that performs discharge from one vent hole (outlet).

In the blower according to the present disclosure, it is desirable that the third vent hole be provided in a region of the side wall portion that surrounds the vibrating portion, and allow the opening portion and the outside of the housing to communicate with each other.

In this structure, the shortest distance from the outer periphery of the first blower chamber to the third vent hole and the shortest distance from the outer periphery of the second blower chamber to the third vent hole are substantially equal to each other. Therefore, when the actuator is driven, the pressure at the outer periphery of the first blower chamber and the pressure at the outer periphery of the second blower chamber both tend to become stable at atmospheric pressure (node).

In the blower according to the present disclosure, it is desirable that a first valve that prevents gas from flowing into the first blower chamber from an outside of the first blower chamber be provided at the first vent hole.

The blower having this structure can prevent gas from flowing into the first blower chamber from the outside of the first blower chamber through the first vent hole by using the first valve. Therefore, the blower having this structure can realize high discharge pressure and high discharge flow rate.

In the blower according to the present disclosure, it is desirable that a second valve that prevents gas from flowing into the second blower chamber from an outside of the second blower chamber be provided at the second vent hole.

The blower having this structure can prevent the gas from flowing into the second blower chamber from the outside of the second blower chamber through the second vent hole by using the second valve. Therefore, the blower having this structure can realize high discharge pressure and high discharge flow rate.

In the blower according to the present disclosure, it is desirable that the driving member be a piezoelectric member.

In the blower according to the present disclosure, it is desirable that the first top plate portion undergo bending vibration as the vibrating portion undergoes bending vibration.

In this structure, since the first top plate portion vibrates as the vibrating portion vibrates, it is possible to essentially increase vibration amplitude. Therefore, the blower according to the present disclosure can further increase discharge pressure and discharge flow rate.

In the blower according to the present disclosure, it is desirable that the second top plate portion undergo bending vibration as the vibrating portion undergoes bending vibration.

In this structure, since the second top plate portion vibrates as the vibrating portion vibrates, it is possible to essentially increase vibration amplitude. Therefore, the blower according to the present disclosure can further increase discharge pressure and discharge flow rate.

In the blower according to the present disclosure, it is desirable that a shortest distance a from a central axis of the first blower chamber to the outer periphery of the first blower chamber and a resonant frequency f of the vibrating portion satisfy a relationship of $0.8\times(k_0c)/(2\pi)\leq af\leq 1.2\times(k_0c)/(2\pi)$, where an acoustic velocity of gas that passes through the first blower chamber is c and a value that satisfies a relationship of a Bessel function of a first kind of $J_0(k_0)=0$ is $k_0$.

In this structure, the vibrating portion and the housing are formed such that the shortest distance of the first blower chamber is a. The driving member vibrates the vibrating portion at the resonant frequency f.

Here, when $af=(k_0c)/(2\pi)$, an outermost node among nodes of vibration of the vibrating portion coincides with a node of pressure vibration of the first blower chamber, and pressure resonance occurs. Further, even when the relationship of $0.8\times(k_0c)/(2\pi)\leq af\leq 1.2\times(k_0c)/(2\pi)$ is satisfied, the outermost node among the nodes of vibration of the vibrating portion substantially coincides with the node of pressure vibration of the first blower chamber.

Therefore, when the relationship of $0.8\times(k_0c)/(2\pi)\leq af\leq 1.2\times(k_0c)/(2\pi)$ is satisfied, the blower having this structure can realize high discharge pressure and high discharge flow rate.

In the blower according to the present disclosure, it is desirable that a shortest distance from a central axis of the second blower chamber to the outer periphery of the second blower chamber be equal to the shortest distance a.

In this structure, the vibrating portion and the housing are formed such that the shortest distances of the first blower chamber and the second blower chamber are both a. The driving member vibrates the vibrating portion at the resonant frequency f.

Here, when $af=(k_0c)/(2\pi)$, an outermost node among nodes of vibration of the vibrating portion coincides with a node of pressure vibration of the first blower chamber and a node of pressure vibration of the second blower chamber, and pressure resonance occurs. Further, even when the relationship of $0.8\times(k_0c)/(2\pi)\leq af\leq 1.2\times(k_0c)/(2\pi)$ is satisfied, the outermost node among the nodes of vibration of the vibrating portion substantially coincides with the node of pressure vibration of the first blower chamber and the node of pressure vibration of the second blower chamber.

Therefore, when the relationship of $0.8\times(k_0c)/(2\pi)\leq af\leq 1.2\times(k_0c)/(2\pi)$ is satisfied, the blower having this structure can realize high discharge pressure and high discharge flow rate from both the first vent hole and the second vent hole.

According to the present disclosure, it is possible to considerably increase discharge flow rate per power consumption.

Figure 1:
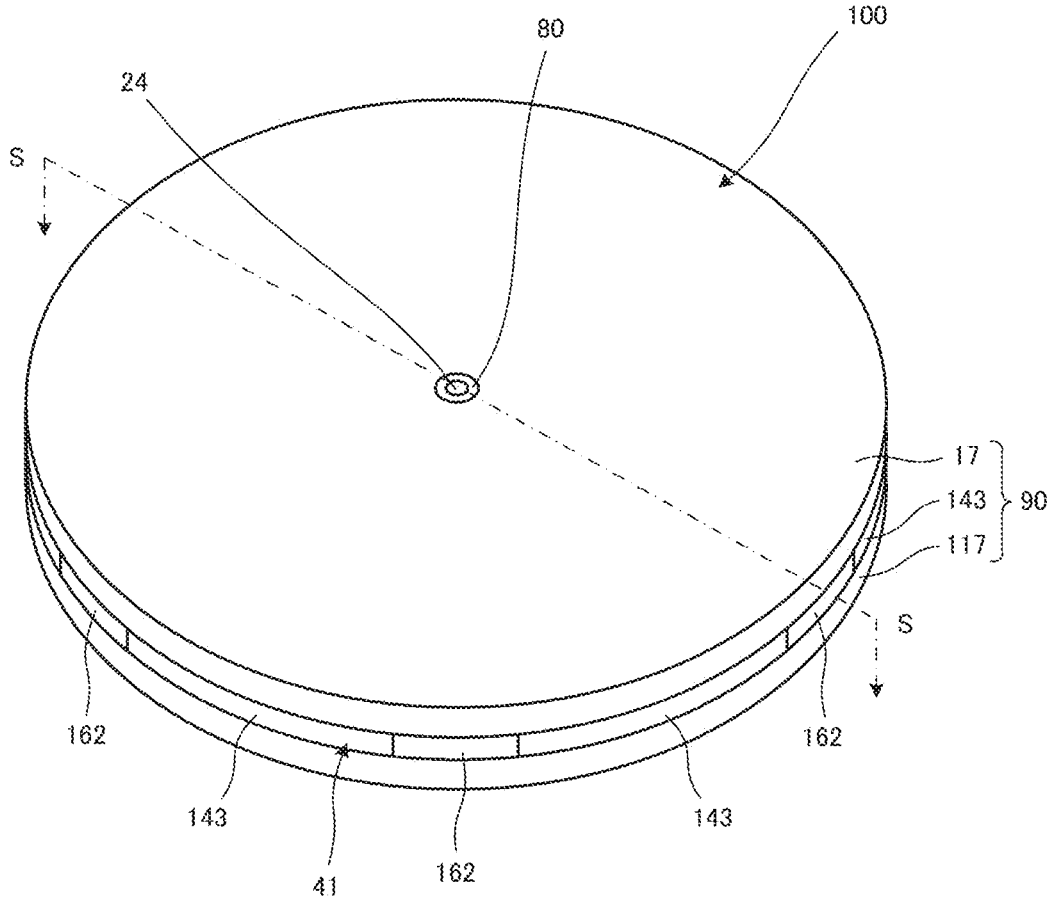
FIG. 1 is an external perspective view of a piezoelectric blower 100 according to an embodiment of the present disclosure.
Figure 5A:
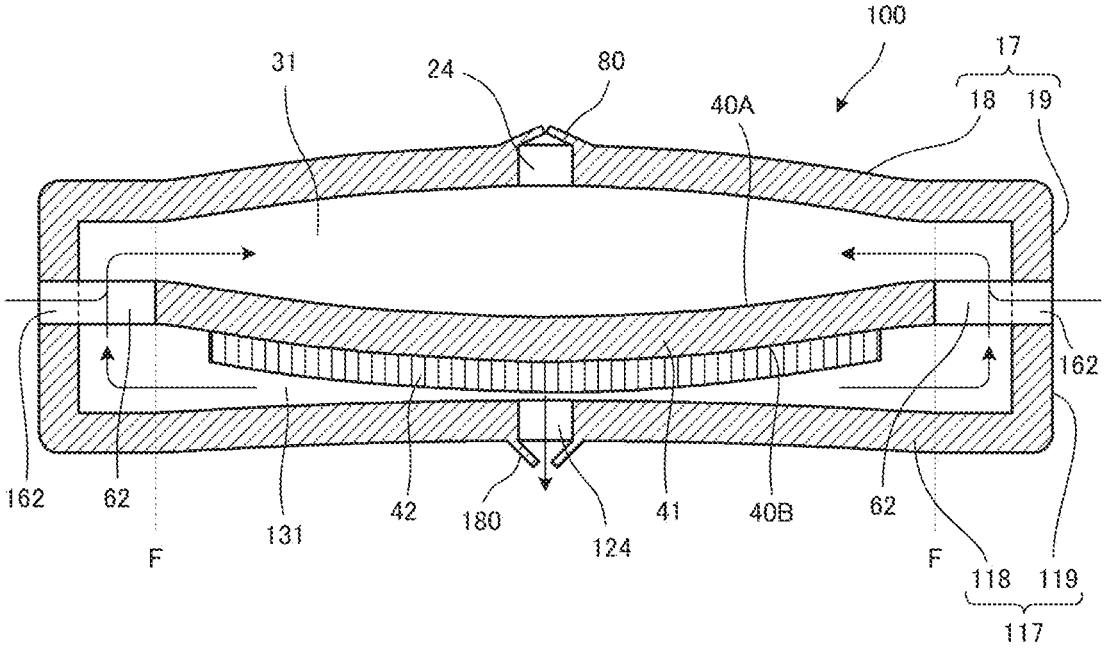
Figure 5B:
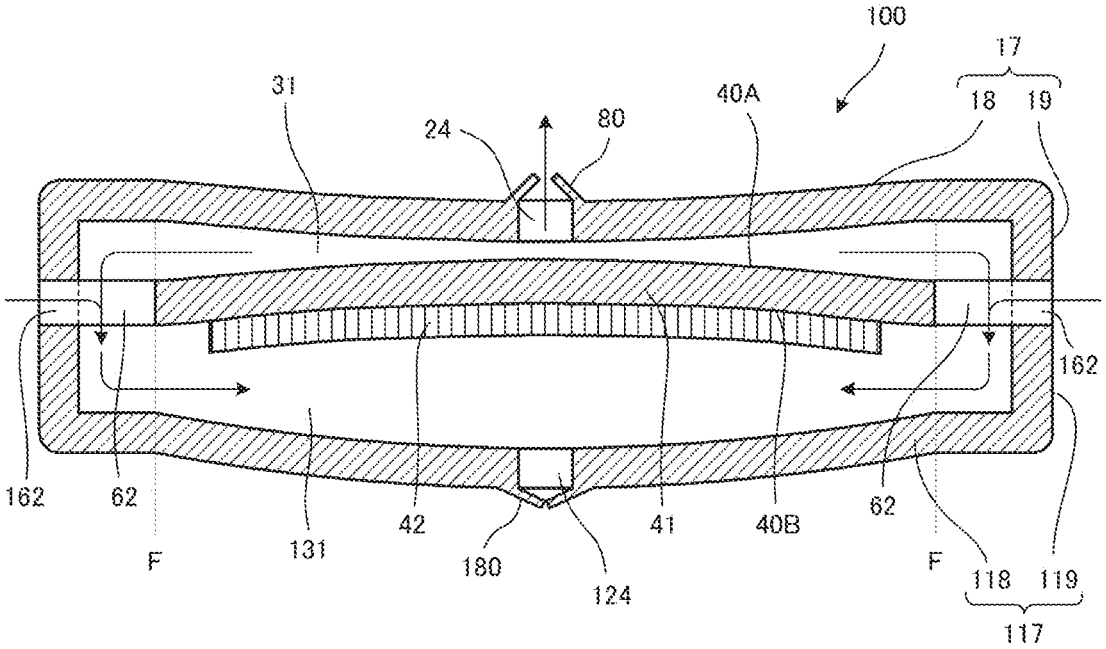

Each of FIGS. 5A and 5B is a sectional view taken along line S-S of the piezoelectric blower 100 shown in FIG. 1 when the piezoelectric blower 100 operates at a first-order mode frequency (fundamental).

Figure 6:
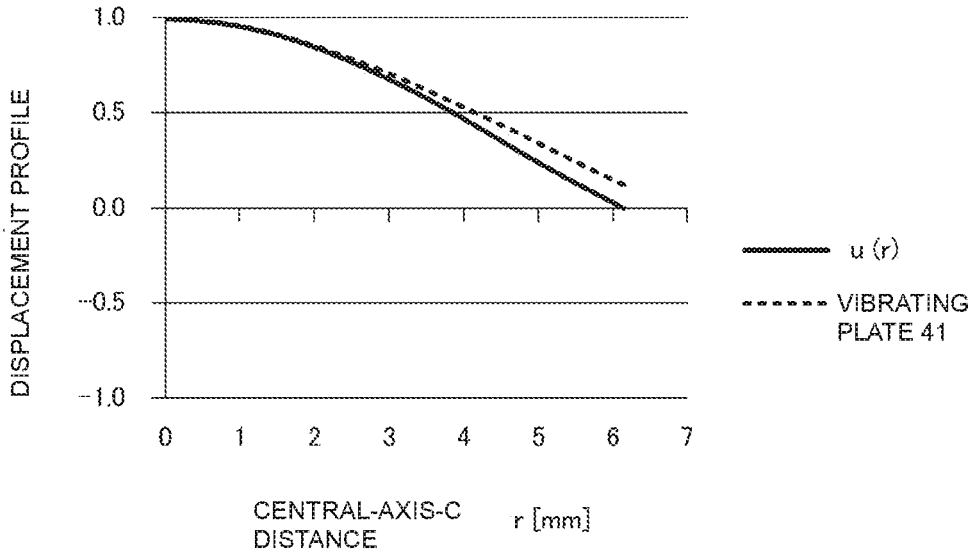

FIG. 6 shows the relationship between pressure change at each point at a first blower chamber 31 and displacement of each point on the vibrating plate 41 in the piezoelectric blower 100 shown in FIG. 1.

Figure 7:
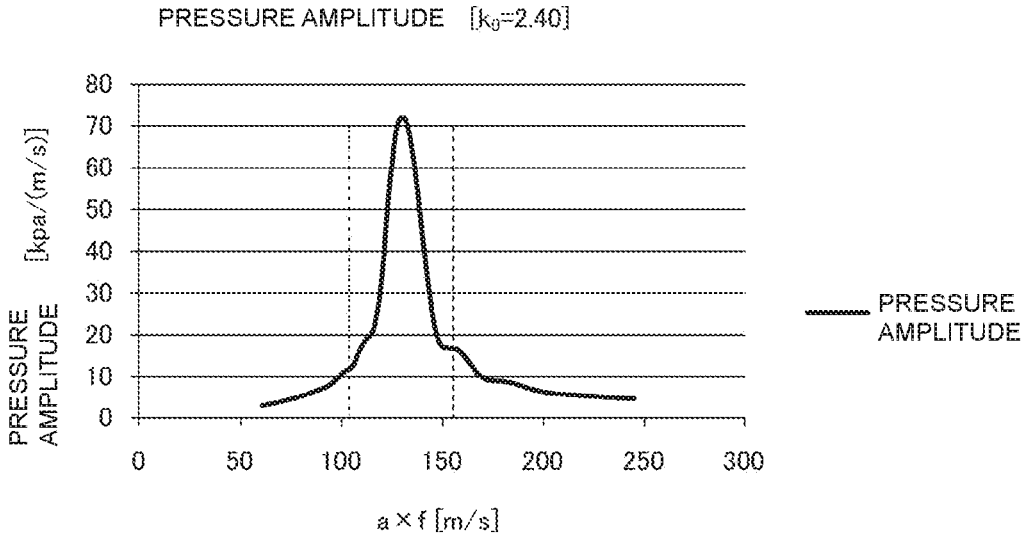

FIG. 7 shows the relationship between radius a×resonant frequency f and pressure amplitude in the piezoelectric blower 100 shown in FIG. 1.

Figure 8:
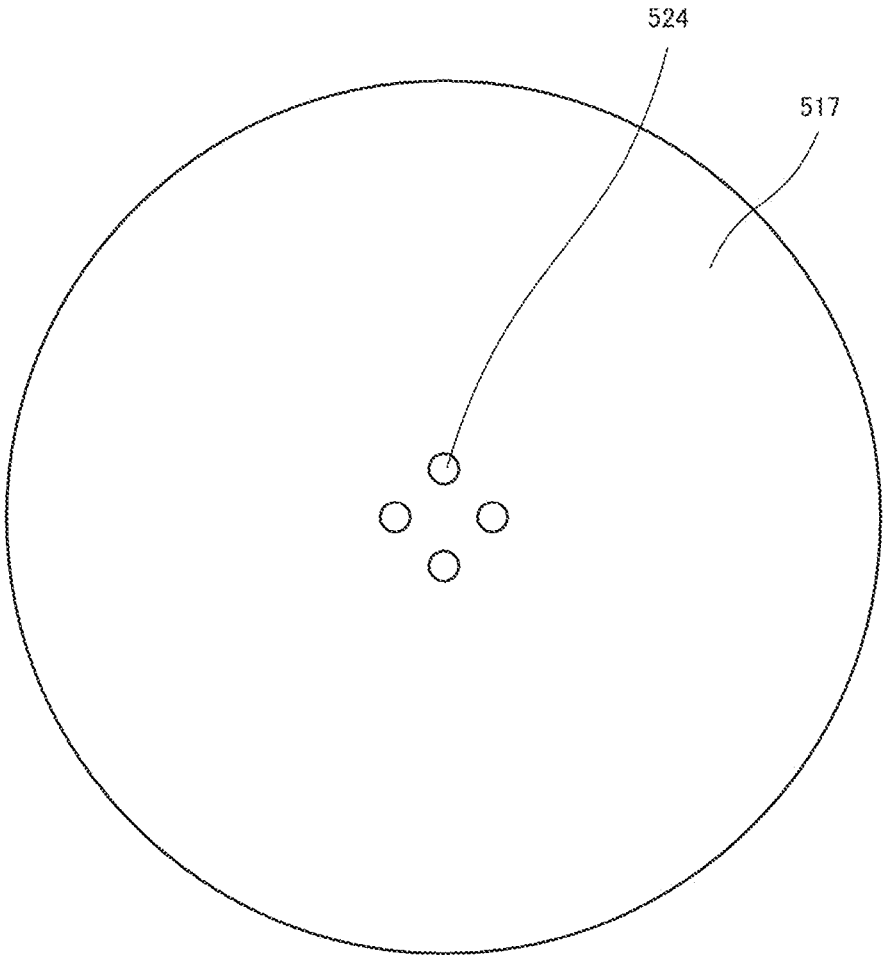

FIG. 8 is a plan view of a housing 517 according to a first modification of a first housing 17 shown in FIG. 1.

Figure 9:
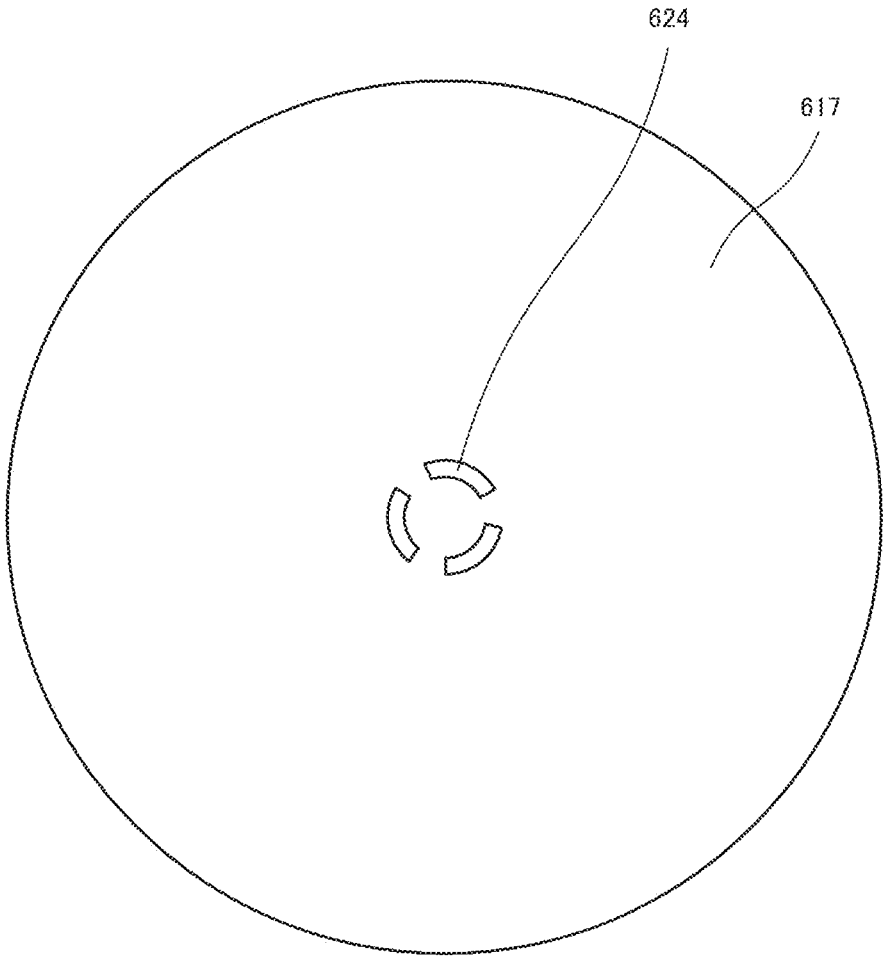

FIG. 9 is a plan view of a housing 617 according to a second modification of the first housing 17 shown in FIG. 1.

Figure 10:
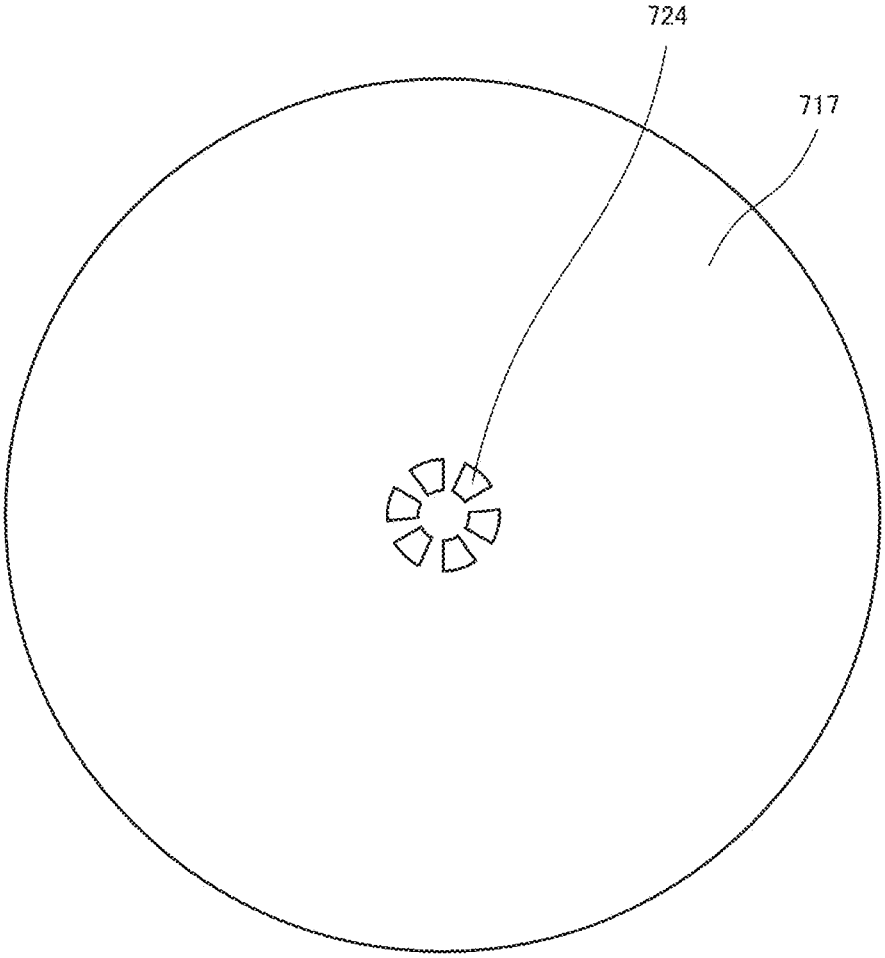

FIG. 10 is a plan view of a housing 717 according to a third modification of the first housing 17 shown in FIG. 1.

Figure 11:
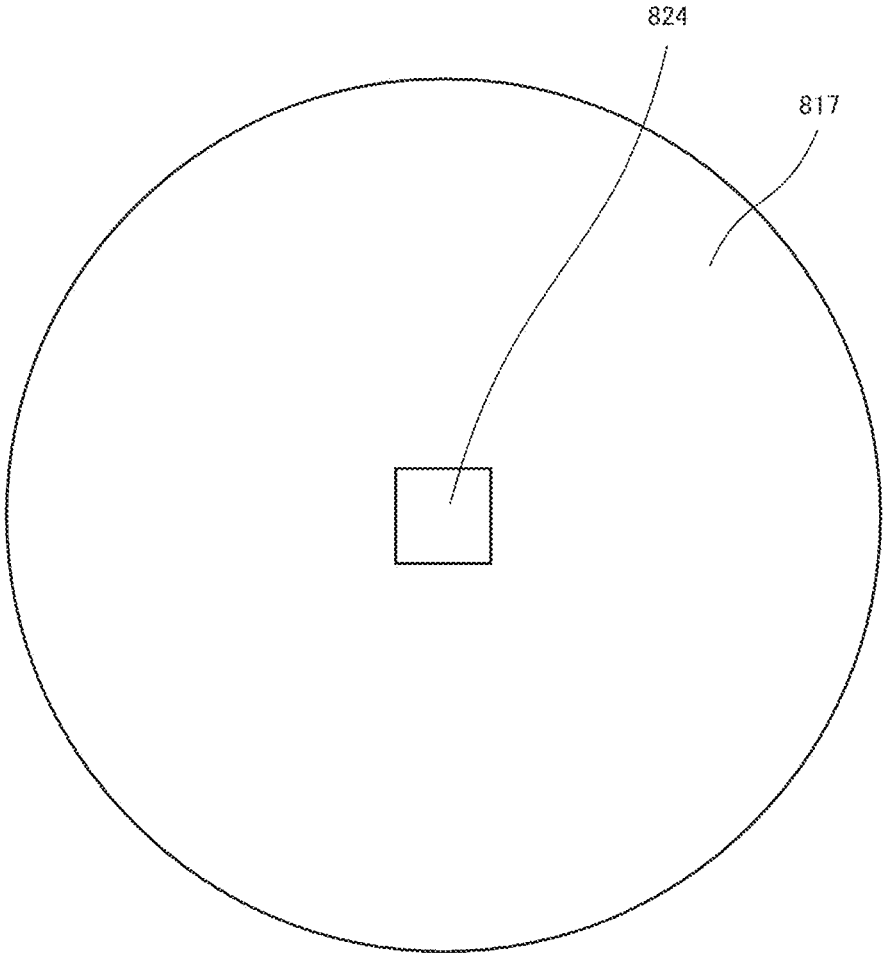

FIG. 11 is a plan view of a housing 817 according to a fourth modification of the first housing 17 shown in FIG. 1.

DETAILED DESCRIPTION OF THE DISCLOSURE

Embodiment of the Present Disclosure

The piezoelectric blower 100 according to an embodiment of the present disclosure is described below.

Figure 2:
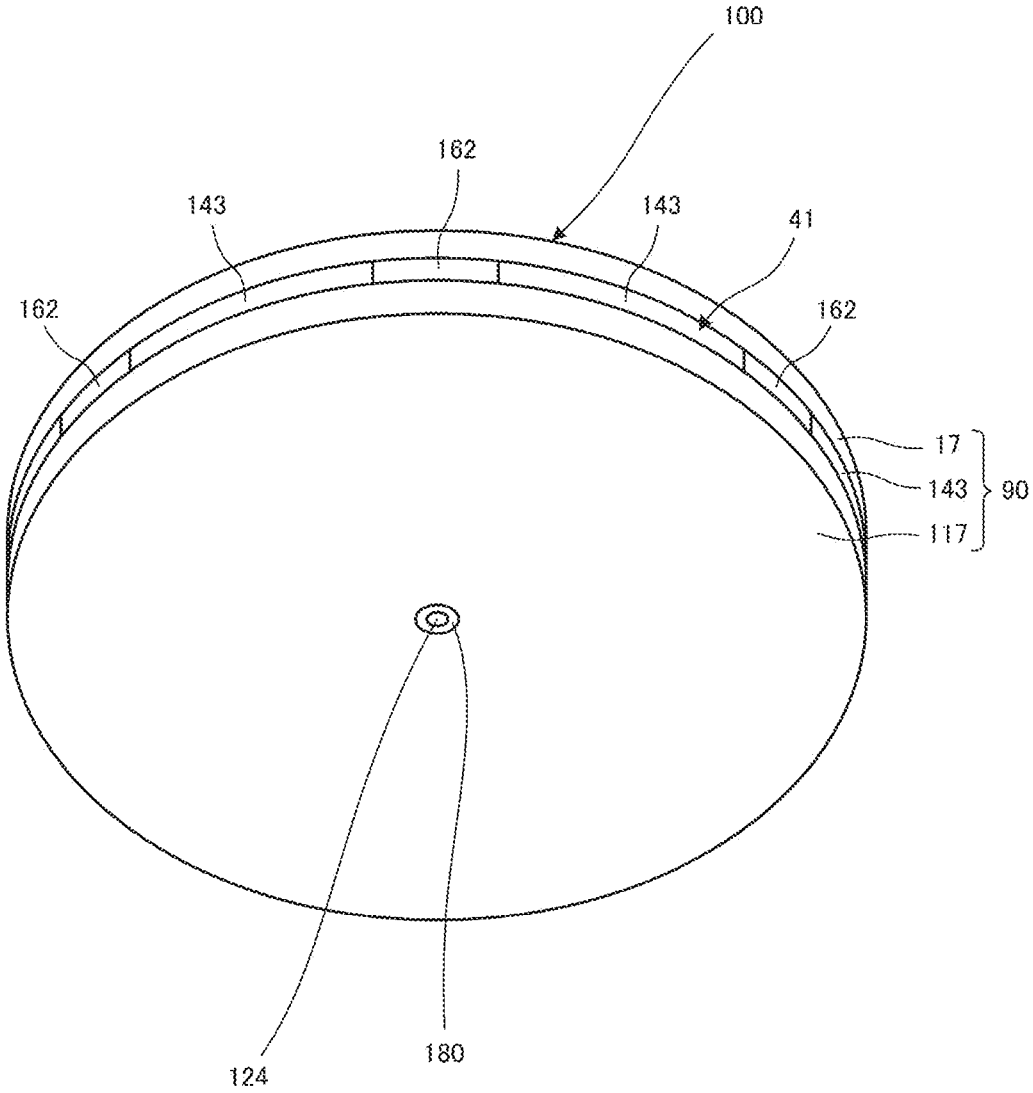
FIG. 2 is an external perspective view of the piezoelectric blower 100 shown in FIG. 1.
Figure 3:
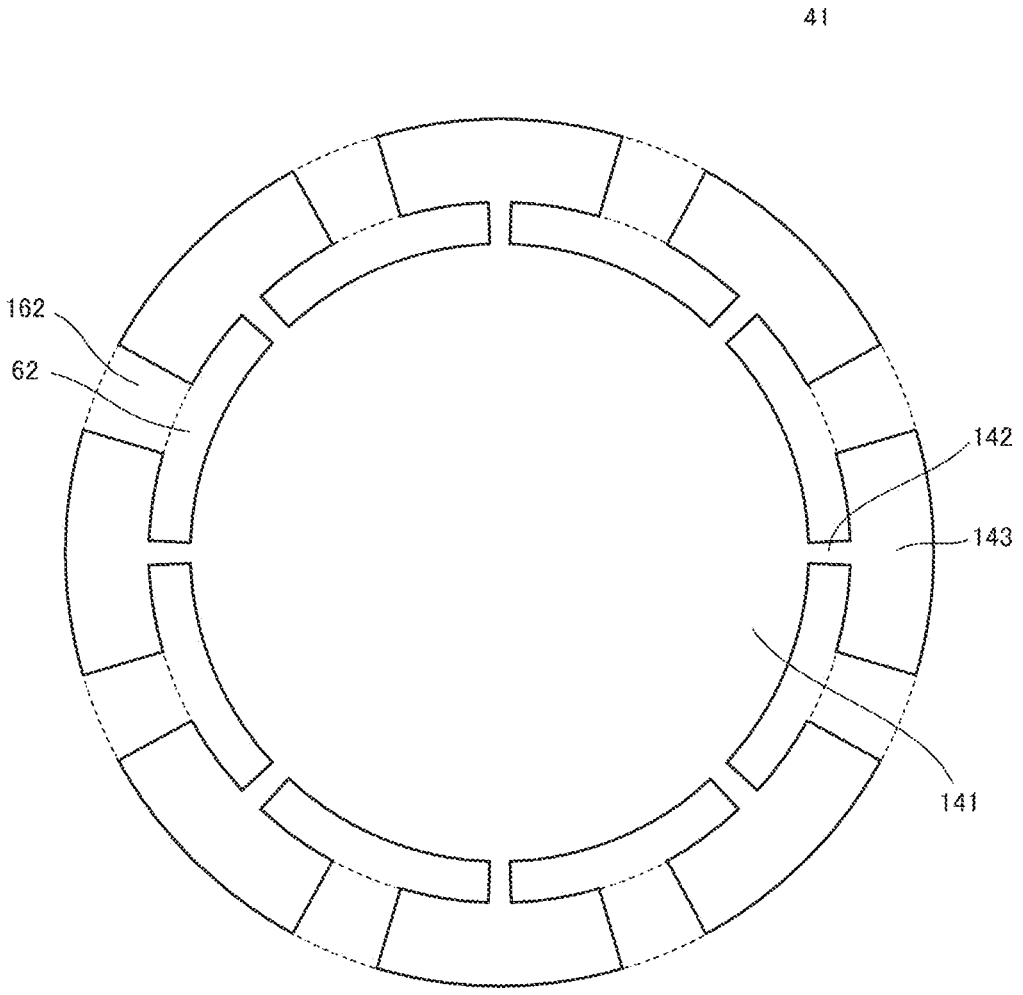
FIG. 3 is a plan view of a vibrating plate 41 shown in FIG. 1.
Figure 4:
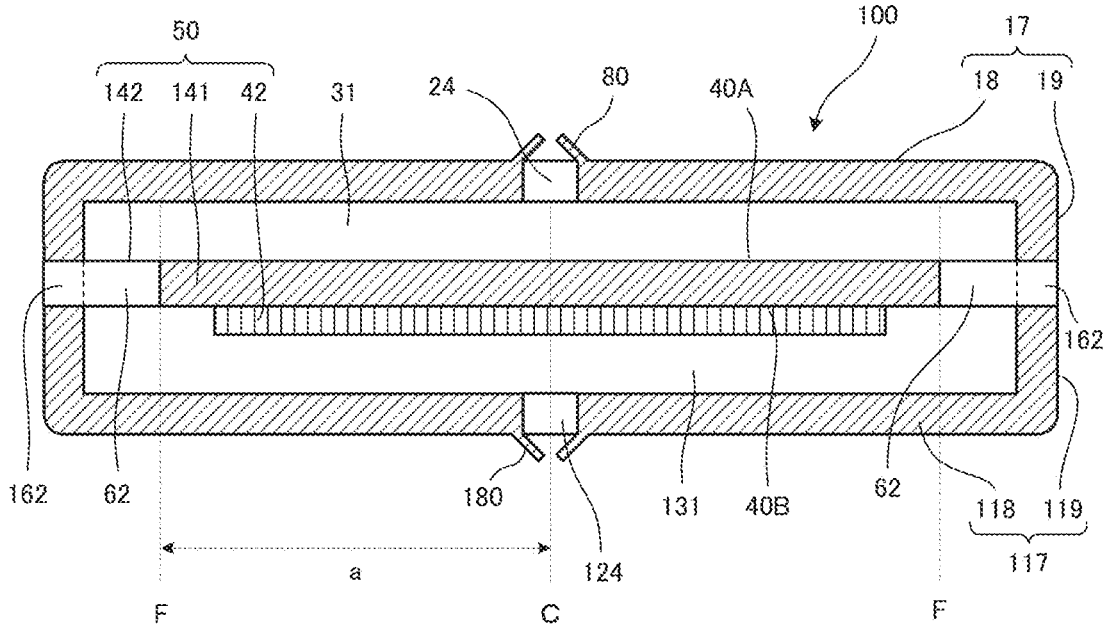
FIG. 4 is a sectional view taken along line S-S of the piezoelectric blower 100 shown in FIG. 1.

FIG. 1 is an external perspective view of the piezoelectric blower 100 according to the embodiment of the present disclosure. FIG. 2 is an external perspective view of the piezoelectric blower 100 shown in FIG. 1. FIG. 3 is a plan view of the vibrating plate 41 shown in FIG. 1. FIG. 4 is a sectional view taken along line S-S of the piezoelectric blower 100 shown in FIG. 1.

The piezoelectric blower 100 includes a first valve 80, the first housing 17, the vibrating plate 41, a piezoelectric element 42, a second housing 117, and a second valve 180 in that order from the top, and has a structure in which these components are successively placed upon each other.

The vibrating plate 41 is disc-shaped, and is made of, for example, stainless steel (SUS). The thickness of the vibrating plate 41 is 0.6 mm. The vibrating plate 41 includes a first principal surface 40A and a second principal surface 40B.

As shown in FIG. 3, the vibrating plate 41 includes a vibrating portion 141, a third side wall portion 143, and a connecting portion 142. The piezoelectric element 42 is provided on the vibrating portion 141, and causes the vibrating portion 141 to undergo bending vibration. The third side wall portion 143 surrounds the vibrating portion 141 and is joined to a first side wall portion 19 and a second side wall portion 119 (described below). The connecting portion 142 connects the vibrating portion 141 to the third side wall portion 143, and elastically supports the vibrating portion 141 with respect to the third side wall portion 143. The vibrating plate 41 is formed by, for example, punching a metallic plate.

The piezoelectric element 42 is disc-shaped, and is made of, for example, a lead zirconate titanate ceramic. Electrodes are formed on two principal surfaces of the piezoelectric element 42. The piezoelectric element 42 is joined to the second principal surface 40B of the vibrating plate 41 at a side of a second blower chamber 131, and expands and contracts in accordance with an applied alternating voltage. Here, the vibrating portion 141, the connecting portion 142, and the piezoelectric element 42 form an actuator 50.

The first housing 17 has a C-shaped cross section having an open bottom. The ends of the first housing 17 are joined to the first principal surface 40A of the vibrating plate 41. The first housing 17 is made of, for example, a metal.

The first housing 17 forms, together with the vibrating plate 41, the column-shaped first blower chamber 31 such that the first blower chamber 31 is interposed therebetween in a thickness direction of the vibrating plate 41. The vibrating plate 41 and the first housing 17 are formed such that the first blower chamber 31 has a radius a. In the embodiment, the radius a of the first blower chamber 31 is 6.1 mm.

The first blower chamber 31 refers to a space that exists inwardly from opening portions 62 (more precisely, a space that exists inwardly from a ring formed by connecting all of the opening portions 62) when the first principal surface 40A of the vibrating plate 41 is viewed from the front. Therefore, a region that exists inwardly from the opening portions 62 at the first principal surface 40A of the vibrating plate 41 (more precisely, a region that exists inwardly from the ring that is formed by connecting all of the opening portions 62) forms a bottom surface of the first blower chamber 31.

The first housing 17 includes a disc-shaped first top plate portion 18 opposing the first principal surface 40A of the vibrating plate 41 and the disc-shaped first side wall portion 19 that is connected to the first top plate portion 18. A portion of the first top plate portion 18 forms a top surface of the first blower chamber 31.

The first top plate portion 18 includes a column-shaped first vent hole 24 that allows a central portion of the first blower chamber 31 to communicate with the outside of the first blower chamber 31. The central portion of the first blower chamber 31 is a portion that overlaps the piezoelectric element 42 when the second principal surface 40B of the vibrating plate 41 is viewed from the front. In the present embodiment, the diameter of the first vent hole 24 is 0.6 mm. The first top plate portion 18 is provided with the first valve 80 that prevents gas from flowing into the first blower chamber 31 from the outside of the first blower chamber 31 through the first vent hole 24.

The second housing 117 has a C-shaped cross section having an open top. The ends of the second housing 117 are joined to the second principal surface 40B of the vibrating plate 41. The second housing 117 is made of, for example, a metal.

The second housing 117 forms, together with the actuator 50, the column-shaped second blower chamber 131 such that the second blower chamber 131 is interposed therebetween in the thickness direction of the vibrating plate 41. The vibrating plate 41 and the second housing 117 are formed such that the second blower chamber 131 has a radius a. In the embodiment, the radius a of the second blower chamber 131 is also 6.1 mm.

The second blower chamber 131 refers to a space that exists inwardly from the opening portions 62 (more precisely, a space that exists inwardly from the ring formed by connecting all of the opening portions 62) when the second principal surface 40B of the vibrating plate 41 is viewed from the front. Therefore, a region that exists inwardly from the opening portions 62 at a second-vent-hole-124-side surface of the actuator 50 (more precisely, a region that exists inwardly from the ring that is formed by connecting all of the opening portions 62) forms a bottom surface of the second blower chamber 131.

The second housing 117 includes a disc-shaped second top plate portion 118 opposing the second principal surface 40B of the vibrating plate 41 and the disc-shaped second side wall portion 119 that is connected to the second top plate portion 118. A portion of the second top plate portion 118 forms a top surface of the second blower chamber 131.

The second top plate portion 118 includes a column-shaped second vent hole 124 that allows a central portion of the second blower chamber 131 to communicate with the outside of the second blower chamber 131. The central portion of the second blower chamber 131 is a portion that overlaps the piezoelectric element 42 when the second principal surface 40B of the vibrating plate 41 is viewed from the front. In the present embodiment, the diameter of the second vent hole 124 is 0.6 mm. The second top plate portion 118 is provided with the second valve 180 that prevents gas from flowing into the second blower chamber 131 from the outside of the second blower chamber 131 through the second vent hole 124.

Here, as shown in FIGS. 1 and 2, the first housing 17, the third side wall portion 143, and the second housing 117 form a housing 90. Therefore, a joined body, where the first side wall portion 19, the third side wall portion 143, and the second side wall portion 119 are joined together, connects the vibrating portion 141 and the connecting portion 142 to the first top plate portion 18 and the vibrating portion 141 and the connecting portion 142 to the second top plate portion 118.

As shown in FIGS. 3 and 4, the vibrating plate 41 includes the opening portions 62 that allow an outer periphery of the first blower chamber 31 and an outer periphery of the second blower chamber 131 to communicate with each other. The opening portions 62 are formed along substantially the entire periphery of the vibrating plate 41 so as to surround the first blower chamber 31 and the second blower chamber 131.

As shown in FIGS. 3 and 4, the vibrating plate 41 includes a plurality of third vent holes 162. That is, the plurality of third vent holes 162 are provided in the third side wall portion 143. The third vent holes 162 allow the opening portions 62 and the outside of the housing 90 to communicate with each other. Therefore, the third vent holes 162 allow the outer periphery of the first blower chamber 31 and the outer periphery of the second blower chamber 131 to communicate with the outside of the housing 90 through the opening portions 62.

In this embodiment, the piezoelectric element 42 corresponds to a "driving member" according to the present disclosure. The vibrating portion 141 and the connecting portion 142 correspond to a "vibrating portion" according to the present disclosure. The first side wall portion 19, the third side wall portion 143, and the second side wall portion 119 correspond to a "side wall portion" according to the present disclosure.

The flow of air when the piezoelectric blower 100 operates is described below.

FIGS. 5A and 5B are sectional views taken along line S-S of the piezoelectric blower 100 shown in FIG. 1 when the piezoelectric blower 100 operates at a first-order mode resonant frequency (fundamental). FIG. 5A illustrates a case in which the volume of the first blower chamber 31 has been maximally increased and in which the volume of the second blower chamber 131 has been maximally reduced, and FIG. 5B illustrates a case in which the volume of the first blower chamber 31 has been maximally reduced and in which the volume of the second blower chamber 131 has been maximally increased. Here, the illustrated arrows denote the flow of air.

FIG. 6 shows the relationship between pressure change at each point at the first blower chamber 31 from a central axis C of the first blower chamber 31 to the outer periphery of the first blower chamber 31 and displacement of each point on the vibrating plate 41 from the central axis C of the first blower chamber 31 to the outer periphery of the first blower chamber 31, at a moment when the piezoelectric blower 100 shown in FIG. 1 is set in the state shown in FIG. 5B.

Here, in FIG. 6, the pressure change at each point at the first blower chamber 31 and the displacement of each point on the vibrating plate 41 are indicated by a value that has been standardized based on the displacement of the center of the vibrating plate 41 existing on the central axis C of the first blower chamber 31.

A pressure change distribution u(r) shown in FIG. 6 is described later. Pressure change at each point at the second blower chamber 131 from a central axis C of the second blower chamber 131 to the outer periphery of the second blower chamber 131, at a moment when the piezoelectric blower 100 shown in FIG. 1 is set in the state shown in FIG. 5A is substantially equal to the pressure change at each point at the first blower chamber 31. This is shown in FIG. 6.

FIG. 7 shows the relationship between radius a×resonant frequency f and pressure amplitude in the first blower chamber 31 of the piezoelectric blower 100 shown in FIG. 1. The dotted lines in FIG. 7 indicate a lower limit and an upper limit of a range satisfying the relationship of $0.8\times(k_0c)/(2\pi)\leq af\leq 1.2\times(k_0c)/(2\pi)$.

The relationship between radius a×resonant frequency f and pressure amplitude in the second blower chamber 131 is substantially the same as the relationship between radius a×resonant frequency f and pressure amplitude in the first blower chamber 31. This is shown in FIG. 7.

When, in the state shown in FIG. 4, an alternating drive voltage with the first-order mode frequency (fundamental) is applied to the electrodes on the two principal surfaces of the piezoelectric element 42, the piezoelectric element 42 expands and contracts and causes the vibrating plate 41 to undergo concentric bending vibration at the first-order mode resonant frequency f.

At the same time, due to pressure variations in the first blower chamber 31 resulting from the bending vibration of the vibrating plate 41, the first top plate portion 18 undergoes concentric bending vibration in the first-order mode as the vibrating plate 41 undergoes the bending vibration (in this embodiment, such that the vibration phase lags by 180 degrees).

Due to pressure variations in the second blower chamber 131 resulting from the bending vibration of the vibrating plate 41, the second top plate portion 118 also undergoes concentric bending vibration in the first-order mode as the vibrating plate 41 undergoes the bending vibration (in this embodiment, such that the vibration phase lags by 180 degrees).

By this, as shown in FIGS. 5A and 5B, the volume of the first blower chamber 31 and the volume of the second blower chamber 131 change periodically.

The radius a of the first blower chamber 31 and the resonant frequency f of the vibrating plate 41 satisfy the relationship of $0.8\times(k_0c)/(2\pi)\leq af\leq 1.2\times(k_0c)/(2\pi)$. In addition, the radius a of the second blower chamber 131 and the resonant frequency f of the vibrating plate 41 also satisfy the relationship of $0.8\times(k_0c)/(2\pi)\leq af\leq 1.2\times(k_0c)/(2\pi)$.

In the embodiment, the resonant frequency f is 21 kHz. The acoustic velocity c of air is 340 m/s. $k_0$ is 2.40. The Bessel function of the first kind $J_0(x)$ is expressed by the following numerical formula.

$$J_0(x) = \sum_{m=0}^{\infty} \frac{(-1)^m}{m!\Gamma(m+1)}\left(\frac{x}{2}\right)^{2m} \quad \text{[Numerical Formula 1]}$$

The pressure change distribution u(r) of the points at the first blower chamber 31 is expressed by the formula $u(r)=J_0(k_0r/a)$, where the distance from the central axis C of the first blower chamber 31 is r. In addition, the pressure change distribution u(r) of the points at the second blower chamber 131 is also expressed by the formula $u(r)=J_0(k_0r/a)$.

As shown in FIG. 5A, when the vibrating plate 41 bends towards the piezoelectric element 42, the first top plate portion 18 bends towards a side opposite to the piezoelectric element 42, so that the volume of the first blower chamber 31 is increased. Further, the second top plate portion 118 bends towards the piezoelectric element 42, so that the volume of the second blower chamber 131 is reduced.

At this time, since the pressure at the central portion of the first blower chamber 31 is reduced, the first valve 80 is closed, and air that exists outside of the housing 90 and air in the second blower chamber 131 are sucked into the first blower chamber 31 through the third vent holes 162 and the opening portions 62. At this time, since the pressure at the central portion of the second blower chamber 131 is increased, the second valve 180 opens, and air in the central portion of the second blower chamber 131 is discharged to the outside of the second housing 117 through the second vent hole 124.

As shown in FIG. 5B, when the vibrating plate 41 bends towards the first blower chamber 31, the first top plate portion 18 bends towards the piezoelectric element 42, so that the volume of the first blower chamber 31 is reduced. Further, the second top plate portion 118 bends towards the side opposite to the piezoelectric element 42, so that the volume of the second blower chamber 131 is increased.

At this time, since the pressure at the central portion of the first blower chamber 31 is increased, the first valve 80 opens, and air in the central portion of the first blower chamber 31 is discharged to the outside of the first housing 17 through the first vent hole 24. In addition, at this time, since the pressure at the central portion of the second blower chamber 131 is reduced, the second valve 180 is closed, and air that exists outside of the housing 90 and air in the first blower chamber 31 are sucked into the second blower chamber 131 through the third vent holes 162 and the opening portions 62.

In the operation of the piezoelectric blower 100 above, as shown in FIGS. 5A and 5B, when the volume of the second blower chamber 131 is reduced, the volume of the first blower chamber 31 is increased, whereas, when the volume of the first blower chamber 31 is reduced, the volume of the second blower chamber 131 is increased. That is, the volume of the first blower chamber 31 and the volume of the second blower chamber 131 change in an opposite manner.

Therefore, when the actuator 50 is driven, air at the outer periphery of the first blower chamber 31 and air at the outer periphery of the second blower chamber 131 move through the opening portions 62. Consequently, when the actuator 50 is driven, the pressure at the outer periphery of the first blower chamber 31 and the pressure at the outer periphery of the second blower chamber 131 cancel out through the opening portions 62, and are atmospheric pressure (node) at all times.

Therefore, even if the outer periphery of the first blower chamber 31 and the outer periphery of the second blower chamber 131 communicate with the outside of the housing 90 through the large opening portions 62 and the third vent holes 162, the piezoelectric blower 100 can prevent a reduction in discharge pressure and discharge flow rate.

The piezoelectric blower 100 is such that, when driving the actuator 50, air in the first blower chamber 31 sucked from the third vent holes 162 is discharged to the outside of the first housing 17 through the first vent hole 24, and air in the second blower chamber 131 sucked from the third vent holes 162 is discharged to the outside of the second housing 117 through the second vent hole 124.

Therefore, the piezoelectric blower 100 having this structure can make the discharge flow rate per power consumption considerably higher than the discharge flow rate of the pump that is described in Patent Document 1 and that performs discharge from one vent hole (outlet).

The piezoelectric blower 100 is capable of intercepting ultrasonic waves emitted from the piezoelectric element 42 by using the second housing 117.

The plurality of third vent holes 162 are provided in the third side wall portion 143.

Therefore, the shortest distance from the outer periphery of the first blower chamber 31 to each third vent hole 162 and the shortest distance from the outer periphery of the second blower chamber 131 to each third vent hole 162 are substantially equal to each other. Consequently, when the actuator 50 is driven, the pressure at the outer periphery of the first blower chamber 31 and the pressure at the outer periphery of the second blower chamber 131 both tend to become stable at atmospheric pressure (node).

The piezoelectric blower 100 includes the first valve 80 and the second valve 180. Therefore, as shown in FIGS. 5A and 5B, air is not sucked into the first blower chamber 31 from the outside of the piezoelectric blower 100 through the first vent hole 24 and air is not sucked into the second blower chamber 131 from the outside of the piezoelectric blower 100 through the second vent hole 124. That is, the piezoelectric blower 100 does not cause air current to flow in opposite directions through the first vent hole 24 and the second vent hole 124. Therefore, in the piezoelectric blower 100, the air can flow in one direction.

In the piezoelectric blower 100, since the first top plate portion 18 and the second top plate portion 118 vibrate as the vibrating plate 41 vibrates, it is possible to essentially increase vibration amplitude. Therefore, the piezoelectric blower 100 according to the present embodiment can further increase discharge pressure and discharge flow rate.

When $af=(k_0c)/(2\pi)$, a node F of vibration of the vibrating plate 41 coincides with a node of pressure vibration of the first blower chamber 31 and a node of pressure vibration of the second blower chamber 131, and pressure resonance occurs.

Further, even when the relationship of $0.8\times(k_0c)/(2\pi)\leq af\leq 1.2\times(k_0c)/(2\pi)$ is satisfied, the node F of vibration of the vibrating plate 41 substantially coincides with the node of pressure vibration of the first blower chamber 31 and the node of pressure vibration of the second blower chamber 131.

The piezoelectric blower 100 is used for sucking a liquid having high viscosity, such as nasal mucus or phlegm. In order to prevent breakage of the piezoelectric element resulting from driving the piezoelectric element for a long time, the vibration speed of the piezoelectric element needs to be less than or equal to 2 m/s.

In order to suck nasal mucus or phlegm, a pressure of 20 kPa or greater is required. Therefore, the piezoelectric blower 100 requires a pressure amplitude of 10 kPa/(m/s) or greater. As shown in FIG. 7, the pressure amplitude becomes a maximum when af is 130 m/s. Even if the pressure amplitude deviates by ±20% from 130 m/s, a pressure amplitude of 10 kPa/(m/s) or greater can be obtained.

Therefore, when the relationship of $0.8\times(k_0c)/(2\pi)\leq af\leq 1.2\times(k_0c)/(2\pi)$ is satisfied, the piezoelectric blower 100 can realize high discharge pressure and high discharge flow rate from both the first vent hole 24 and the second vent hole 124.

As shown in FIGS. 5A and 5B and the dotted line in FIG. 6, each point on the vibrating plate 41 from the central axis C of the first blower chamber 31 to the outer periphery of the first blower chamber 31 is displaced by vibration. As shown by the solid line in FIG. 6, from the central axis C of the first blower chamber 31 to the outer periphery of the first blower chamber 31, the pressure at each point at the first blower chamber 31 is changed due to the vibrating plate 41 being vibrated. Similarly, from the central axis C of the second blower chamber 131 to the outer periphery of the second blower chamber 131, the pressure at each point at the second blower chamber 131 is changed due to the vibrating plate 41 being vibrated.

As shown by the dotted line and the solid line in FIG. 6, in the range from the central axis C of the first blower chamber 31 to the outer periphery of the first blower chamber 31, the number of zero crossover points of the vibration displacement of the vibrating plate 41 is zero, the number of zero crossover points of the pressure change at the first blower chamber 31 is also zero, and the number of zero crossover points of the pressure change at the second blower chamber 131 is also zero.

Therefore, the number of zero crossover points of the vibration displacement of the vibrating plate 41 is equal to the number of zero crossover points of the pressure change at the first blower chamber 31 and the number of zero crossover points of the pressure change at the second blower chamber 131.

Therefore, in the piezoelectric blower 100, when the vibrating plate 41 vibrates, a distribution of the displacements of the respective points on the vibrating plate 41 becomes a distribution that is close to the distribution of the pressure changes at the respective points at the first blower chamber 31 and the distribution of the pressure changes at the respective points at the second blower chamber 131.

Therefore, the piezoelectric blower 100 is capable of transmitting vibration energy of the vibrating plate 41 to air in the first blower chamber 31 and the second blower chamber 131 almost without loss of the vibration energy of the vibrating plate 41. Consequently, the piezoelectric blower 100 can realize high discharge pressure and high discharge flow rate.

Other Embodiments

Although, in the above-described embodiment, air is used as the fluid, the present disclosure is not limited thereto. The fluid may be a gas other than air.

Although, in the above-described embodiment, the vibrating plate 41 is made of SUS, the present disclosure is not limited thereto. The vibrating plate 41 may be made of other materials, such as aluminum, titanium, magnesium, or copper.

Although, in the above-described embodiment, the piezoelectric element 42 is provided as the driving source of the blower, the present disclosure is not limited thereto. For example, the piezoelectric element 42 may be formed as a blower that performs pumping by electromagnetic driving.

Although, in the above-described embodiment, the piezoelectric element 42 is made of a lead zirconate titanate ceramic, the present disclosure is not limited thereto. For example, the piezoelectric element 42 may be made of piezoelectric materials of a non-lead piezoelectric ceramic such as a potassium sodium niobate based ceramic or an alkali niobate based ceramic.

Although, in the above-described embodiment, a unimorph piezoelectric vibrator is used, the present disclosure is not limited thereto. A bimorph piezoelectric vibrator in which the piezoelectric element 42 is attached to each of two surfaces of the vibrating plate 41 may be used.

Although, in the above-described embodiment, the disc-shaped piezoelectric element 42, the disc-shaped vibrating plate 41, and the disc-shaped first top plate portion 18, and the disc-shaped second top plate portion 118 are used, the present disclosure is not limited thereto. For example, they may have a rectangular or a polygonal shape.

Although, in the above-described embodiment, the vibrating plate 41 undergoes concentric bending vibration, the present disclosure is not limited thereto. For implementation, the vibrating plate 41 may undergo bending vibration of a form other than concentric bending vibration.

Although, in the above-described embodiment, the first top plate portion 18 and the second top plate portion 118 undergo concentric bending vibration as the vibrating plate 41 undergoes bending vibration, the present disclosure is not limited thereto. For implementation, only the vibrating plate 41 may undergo bending vibration, that is, the first top plate portion 18 and the second top plate portion 118 need not undergo bending vibration as the vibrating plate 41 undergoes bending vibration.

Although, in the above-described embodiment, $k_0$ is 2.40 or 5.52, the present disclosure is not limited thereto. $k_0$ may be any value that satisfies the relationship of $J_0(k_0)=0$, such as 8.65, 11.79, or 14.93.

Although, in the above-described embodiment, the piezoelectric element 42 is joined to the second principal surface 40B of the vibrating plate 41 at the side of the second blower chamber 131, the present disclosure is not limited thereto. For implementation, for example, the piezoelectric element 42 may be joined to the first principal surface 40A of the vibrating plate 41 at a side of the first blower chamber 31, or two piezoelectric elements 42 may be joined to the first and second principal surfaces 40A and 40B of the vibrating plate 41.

In this case, the first housing 17 and the second housing 117 form, together with an actuator including at least one piezoelectric element 42 and the vibrating plate 41, a first blower chamber and a second blower chamber such that the first blower chamber is interposed between the first housing 17 and the actuator in the thickness direction of the vibrating plate 41 and such that the second blower chamber is interposed between the second housing 117 and the actuator in the thickness direction of the vibrating plate 41.

Although, in the above-described embodiment, the vibrating plate of the piezoelectric blower undergoes bending vibration at the first-order mode frequency or the third-order mode frequency, the present disclosure is not limited thereto. For implementation, the vibrating plate may undergo bending vibration in a vibration mode of a third-order mode or a higher odd-order mode producing a plurality of vibration antinodes.

Although, in the above-described embodiment, the first blower chamber 31 and the second blower chamber 131 are column-shaped, the present disclosure is not limited thereto. For implementation, the blower chambers may have the shape of a regular prism. In this case, instead of using the radius a of each blower chamber, the shortest distance a from the central axis of each blower chamber to the outer periphery of each blower chamber is used.

Although, in the above-described embodiment, the first top plate portion 18 of the first housing 17 includes one circular first vent hole 24, and the second top plate portion 118 of the second housing 117 also includes one circular second vent hole 124, the present disclosure is not limited thereto. For implementation, for example, as shown in FIGS. 8 to 10, a plurality of vent holes 524 to a plurality of vent holes 724 may be provided; or, for example, as with the vent holes 624 and the vent holes 724 shown in FIGS. 9 and 10 and a vent hole 824 shown in FIG. 11, the vent hole or vent holes need not be circular.

Although, in the above-described embodiment, the first valve 80 is provided at the first vent hole 24, and the second valve 180 is provided at the second vent hole 124, the present disclosure is not limited thereto. For implementation, the valve need not be provided.

If the valve is not provided, when, as shown in FIG. 5A, the vibrating plate 41 bends towards the piezoelectric element 42, air current in a direction opposite to that in FIG. 5B is generated. Therefore, discharge flow and suction flow at a high wind speed are alternately generated from the first vent hole 24 and the second vent hole 124. That is, a strong reciprocating current can be produced. Such a strong reciprocating current can be used for, for example, cooling heat-generating parts.

Although, in the above-described embodiment, the third vent holes 162 are provided in the third side wall portion 143, the present disclosure is not limited thereto. For implementation, the third vent holes 162 may be formed in the first side wall portion 19 or the second side wall portion 119.

Lastly, the description of the above-described embodiment is to be considered in all respects only as illustrative and not restrictive. The scope of the present disclosure is indicated by the claims rather than by the above-described embodiment. Further, all changes which come within the meaning and range of equivalency of the claims are to be embraced within the scope of the present disclosure.

a radius
C central axis
F node
17 first housing
18 first top plate portion

19 first side wall portion
24 first vent hole
31 first blower chamber
40A first principal surface
40B second principal surface
41 vibrating plate
42 piezoelectric element
50 actuator
62 opening portion
80 first valve
90 housing
100 piezoelectric blower
117 second housing
118 second top plate portion
119 second side wall portion
124 second vent hole
131 second blower chamber
141 vibrating portion
142 connecting portion
143 third side wall portion
162 third vent hole
180 second valve
517 housing
524 vent hole
617 housing
624 vent hole
717 housing
724 vent hole
817 housing
824 vent hole

The invention claimed is:

1. A blower comprising:

an actuator including a vibrating portion and a driving member, the vibrating portion including a first principal surface and a second principal surface, the driving member being provided on at least one of the first principal surface and the second principal surface of the vibrating portion, the driving member causing the vibrating portion to undergo bending vibration; and a housing including a first top plate portion, a second top plate portion, and a side wall portion, the first top plate portion forming, together with the actuator, a first blower chamber and including a first vent hole, the second top plate portion forming, together with the actuator, a second blower chamber and including a second vent hole, the side wall portion connecting the first top plate portion to the vibrating portion and connecting the second top plate portion to the vibrating portion, wherein the vibrating portion includes a plurality of opening portions allowing an outer periphery of the first blower chamber and an outer periphery of the second blower chamber to communicate with each other, the plurality of opening portions surrounding the first blower chamber and the second blower chamber, and wherein the side wall portion includes a plurality of third vent holes allowing the outer periphery of the first blower chamber and the outer periphery of the second blower chamber to communicate with an outside of the housing, and wherein each third vent hole communicates with the first blower chamber and the second blower chamber indirectly via an associated opening port, and wherein each third vent hole extends circumferentially about a central axis of the blower a first distance, and each opening portion extends circumferentially about the central axis a second distance that is longer than the first distance.

2. The blower according to claim 1, wherein each third vent hole is provided in a region of the side wall portion surrounding the vibrating portion, and allows its associated opening portion and the outside of the housing to communicate with each other.

3. The blower according to claim 1, wherein a first valve preventing a gas from flowing into the first blower chamber from an outside of the first blower chamber is provided at the first vent hole.

4. The blower according to claim 1, wherein a second valve preventing the gas from flowing into the second blower chamber from an outside of the second blower chamber is provided at the second vent hole.

5. The blower according to claim 1, wherein the driving member is a piezoelectric member.

6. The blower according to claim 1, wherein the first top plate portion undergoes bending vibration as the vibrating plate undergoes bending vibration.

7. The blower according to claim 1, wherein the second top plate portion undergoes bending vibration as the vibrating plate undergoes bending vibration.

8. The blower according to claim 1, wherein a shortest distance a from a central axis of the first blower chamber to the outer periphery of the first blower chamber and a resonant frequency f of the vibrating plate satisfy a relationship of $0.8\times(k_0c)/(2\pi)\leq af\leq 1.2\times(k_0c)/(2\pi)$, where an acoustic velocity of gas that passes through the first blower chamber is c, a Bessel function of the first kind is Jo(x), and ko is a value that satisfies a relationship of the Bessel function of the first kind in which Jo(ko)=0.

9. The blower according to claim 8, wherein a shortest distance from a central axis of the second blower chamber to the outer periphery of the second blower chamber is equal to the shortest distance a.

10. The blower according to claim 2, wherein a first valve preventing a gas from flowing into the first blower chamber from an outside of the first blower chamber is provided at the first vent hole.

11. The blower according to claim 2, wherein a second valve preventing the gas from flowing into the second blower chamber from an outside of the second blower chamber is provided at the second vent hole.

12. The blower according to claim 3, wherein a second valve preventing the gas from flowing into the second blower chamber from an outside of the second blower chamber is provided at the second vent hole.

13. The blower according to claim 2, wherein the driving member is a piezoelectric member.

14. The blower according to claim 3, wherein the driving member is a piezoelectric member.

15. The blower according to claim 4, wherein the driving member is a piezoelectric member.

16. The blower according to claim 2, wherein the first top plate portion undergoes bending vibration as the vibrating plate undergoes bending vibration.

17. The blower according to claim 3, wherein the first top plate portion undergoes bending vibration as the vibrating plate undergoes bending vibration.

18. The blower according to claim 4, wherein the first top plate portion undergoes bending vibration as the vibrating plate undergoes bending vibration.

19. The blower according to claim 5, wherein the first top plate portion undergoes bending vibration as the vibrating plate undergoes bending vibration.

20. The blower according to claim 2, wherein the second top plate portion undergoes bending vibration as the vibrating plate undergoes bending vibration.

21. The blower according to claim 1, wherein the plurality of third vent holes, the plurality of opening portions, and a main body of the vibrating portion are aligned such that a common plane passes through the plurality of third vent holes, the plurality of opening portions, and the main body.

22. The blower according to claim 1, wherein each third vent hole extends radially a third distance that is longer than the first distance, and each opening portion extends radially a fourth distance that is shorter than the second distance.

23. The blower according to claim 1, wherein each third vent hole intersects with a central portion of its associated opening portion.

* * * * *